United States Patent [19]

Seragnoli

[11] Patent Number: 4,461,415

[45] Date of Patent: Jul. 24, 1984

[54] DEVICE FOR BREAKING AT LEAST ONE CONTINUOUS ROD IN A MACHINE FOR MAKING PRODUCTS FOR SMOKERS

[75] Inventor: Enzo Seragnoli, Bologna, Italy

[73] Assignee: G.D. Società per Azioni, Bologna, Italy

[21] Appl. No.: 402,800

[22] Filed: Jul. 27, 1982

[30] Foreign Application Priority Data

Oct. 8, 1981 [IT] Italy ..... 49454 A/81

[51] Int. Cl.[3] ..... A24C 5/31

[52] U.S. Cl. ..... 225/98; 225/4; 225/103

[58] Field of Search ..... 225/98, 4, 103

[56] References Cited

U.S. PATENT DOCUMENTS 4,226,352 10/1980 Watson .

FOREIGN PATENT DOCUMENTS 1042148 9/1966 United Kingdom .

1280981 7/1972 United Kingdom .

*Primary Examiner*—F. T. Yost

*Attorney, Agent, or Firm*—Cushman, Darby & Cushman

[57] ABSTRACT

A device for breaking at least one continuous rod in a machine for making products for smokers comprises a separating element movable in between a first position of intersection with the path of the rod and a second position external thereto; an operating mechanism includes a helical torsion spring mounted on a shaft integral with the separating element to drive the latter alternately from one position to the other; a restraint member, interlocked to a control device, withholds the separating element against the action of the helical spring and a reloading device reloads the latter each time the separating element has moved from one of the said positions to the other.

4 Claims, 8 Drawing Figures

DEVICE FOR BREAKING AT LEAST ONE CONTINUOUS ROD IN A MACHINE FOR MAKING PRODUCTS FOR SMOKERS

BACKGROUND OF THE INVENTION

The invention relates to a device for breaking at least one continuous rod in a machine for making products for smokers.

DESCRIPTION OF THE PRIOR ART

In the said type of machine, one or more continuous cigarette or filter rods are formed by enclosing tobacco or filtering material in paper webs that are supplied in an uninterrupted sequence and on which one edge is pre-provided with adhesive.

Using a cutting device, the said rods are subsequently divided into small lengths of cigarettes or filters.

Taking as an example a cigarette making machine able to produce one single rod of tobacco, it is known that when the machine is started, it produces a rod that the special means of verification provided have found not to possess suitable characteristics for use in the production of cigarettes because of a lack of compactness, the weight not being constant, and the paper web not being continuously glued.

This being so, it is necessary, each time the machine is started, to reject the rod from the leading end onwards for as far as the said characteristics continue to be unsatisfactory and, in actual practice, this is done in the way described below, through the use of a special device, namely the said separating element.

The rod of tobacco projecting from the cigarette making machine is made to deviate from the rectilineal path that would have taken it to the cutting device and is sent, instead, towards a collection bin.

Once the rated speed of the cigarette making machine has been attained, or more generally when the said characteristics of the rod correspond to predetermined values, the part of the rod placed downstream of the deflector, in the forward movement direction thereof, is broken.

As a consequence of the said breaking operation, the new leading end of the rod is free to go towards the said cutting device.

Not only in the case described related to the start up but also during the normal running of the cigarette making machine, action may be required on the part of an element with which to break the rod of tobacco, due to emergency conditions having arisen (for example, there could be choking downstream of the cutting device).

In such an event, after the breaking operation has taken place, the purpose of this being to interrupt the supply of the rod to the cutting device, the procedure seen previously when starting the machine is followed, that is to say, the rod projecting from the cigarette making machine is made to deviate towards a collection bin, and normal operating conditions are resumed with the deflected section being cut off and the new leading end of the rod being supplied to the cutting device.

In British Pat. No. 1,042,148 a description is given of a device for breaking the rod of tobacco that is functional solely at the time the machine is being started.

The said device comprises deviation means constituted by a movable arcuate deflector that is able to re-route, when placed in a given position, the rod from the rectilineal path towards a collection bin.

The separating element described in the said patent is constituted by the said arcuate deflector itself which, upon completion of the start-up stage, is displaced from the position of deviation to a position external to the path followed by the rod, passing across the latter.

One problem with the device as described is that there are limitations in the operating speed of the separating element due to this being powered by electromagnetic operating means.

In consequence of the said limitations, instead of the rod moving forward at a very high speed towards the cutting device being broken cleanly by the separating element, it is lacerated longitudinally over a certain distance, causing an abundant outflow of tobacco.

The operating speed of the separating element is increased, in British Pat. No. 1,280,981, because of the said electromagnetic means being replaced by a spring.

Each breaking operation of the rod at the time the machine is being started presupposes the releasing of the said spring, and to re-load the latter it is necessary to return the separating element to the initial position thereof. This has to be done when the cigarette making machine is temporarily at a standstill, since in order to be returned to the initial position, the separating element has to cross the path followed by the rod.

It thus ensues that the said separating element, after having operated during the start-up of the machine, is not able to come into action should any emergency conditions arise while the cigarette making machine is on a production run.

For the said reason, provision is made in British Pat. No. 1,280,981 for a second separating element that is independent of the first separating element and is destined to function solely under emergency conditions of the cigarette making machine.

SUMMARY OF THE INVENTION

The object of the invention is to construct a breaking device able to overcome all the difficulties encountered with the known art, and namely a fully automatic breaking device that is given a very high operating speed and is in a position to function at any time, both when the machine is being started and under any emergency condition.

This and other objects too are all attained with the device for breaking at least one continuous rod in a machine for making products for smokers, comprising a separating element movable across the path of the said rod from a first to a second position, wherein there are operating means of an elastic type for displacing the said separating element alternately from the said first to the said second position, and from the said second to the said first position, automatic means for loading the said operating means of an elastic type, means for restraining the said separating element in positions corresponding to the said first and the said second position, and means for controlling the said means of restraint.

BRIEF DESCRIPTION OF THE DRAWINGS

Further characteristics and advantages of the invention will become more apparent from the detailed description that follows of one preferred form of embodiment, illustrated purely as an unlimited example on the accompanying drawings, in which.

DESCRIPTION OF THE PREFERRED EMBODIMENT

Figure 1:
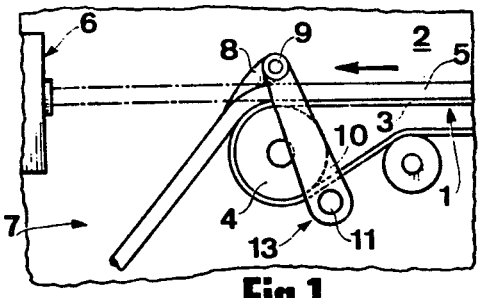
FIGS. 1 and 2 show diagrammatically, the separating element according to the invention in two different operating conditions.
Figure 2:
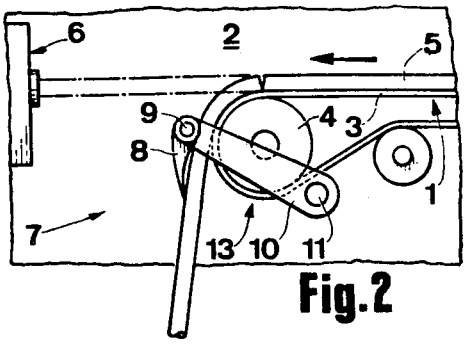

With reference to FIGS. 1 and 2, shown globally at 1 there is a conveyor belt that moves horizontally and is supported by a vertical wall 2 belonging to the casing of a non-illustrated cigarette making machine.

The said conveyor 1 is provided with a belt 3 mounted endlessly around rollers 4 (one only of which is visible in the figures), the axes of these being perpendicular to the wall 2.

When the cigarette making machine is running under normal conditions, the conveyor belt 1 supplies a rod of tobacco 5 coming from non-illustrated forming apparatus, to a verification device 6.

In the region of the downstream extremity of the rod, in the forward movement direction of the conveyor 1, a breaking device shown globally at 7 operates.

Figure 3:
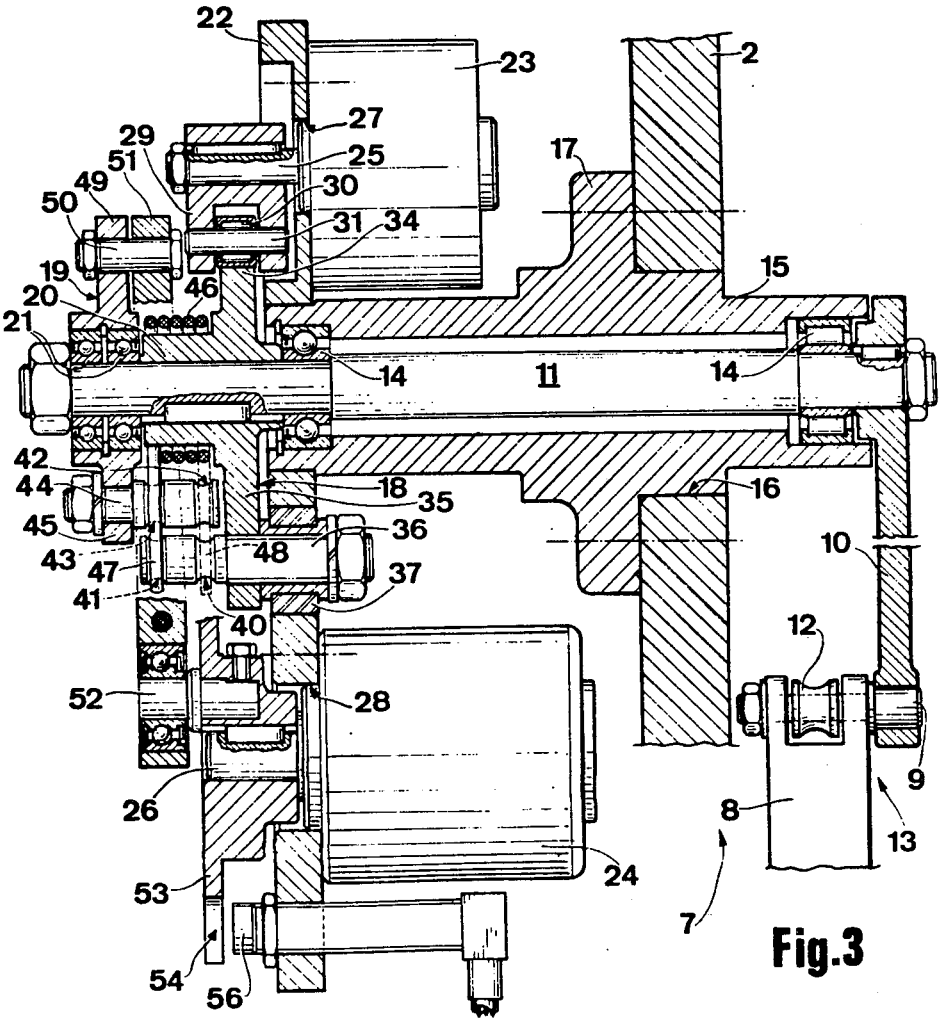
FIG. 3 shows, in a view from above and in sectional form, the mechanism that operates the device in question.

The said breaking device 7 comprises (see FIGS. 1 and 2) an arcuate deflector 8 mounted, through a pin 9, on one extremity of a rod 10 that is pivoted to one extremity of a shaft 11 perpendicular to the wall 2 (see also FIG. 3).

A loosely turning roller 12 is also mounted on the said pin 9, in a hollow space in the deflector 8. The rod 10, the arcuate deflector 8 and the loosely turning roller 12 jointly define an element 13 for separating the rod of tobacco 5.

In accordance with what is shown in FIG. 3, the aforementioned shaft 11 is mounted, with the interposition of two bearings 14, inside a sleeve 15 which, in the region of a hole 16, passes through the wall 2 and is secured to this via a flange 17.

The other extremity of the shaft 11 projects from the sleeve 15 and supports, from right to left when looking at FIG. 3, a first and a second two-arm lever shown at 18 and 19, respectively.

The two-arm lever 18 is keyed to the shaft 11 and, on the side turned towards the lever 19, is provided with a tubular element 20 coaxial to the shaft 11, while the two-arm lever 19 is supported in a rotatable fashion by the said shaft 11 via two bearings 21.

Mounted on the extremity of the sleeve 15 close to the lever 18 there is a plate 22 parallel to the wall 2. The said plate 22 supports, in the space in between it and the said wall 2, a rotating electromagnet 23 and an electric motor 24, the former situated above and the latter situated below the sleeve 15 (see FIG. 3).

The shafts of the electromagnet 23 and the motor 24, shown at 25 and 26, respectively, pass through the plate 22 at points where the holes 27 and 28, respectively, are provided. Rigidly mounted on the shaft 25 there is a bar 29 and in the free extremity of this is machined a bifurcation inside which is housed a loosely turning roller 30 that is supported by a pin 31 parallel to the shaft 25.

The said roller 30 which, in combination with the bar 29, defines the means for restraining the breaking device 7 can, as shown in FIGS. 4 to 7, be engaged in one or the other of the two recesses 32 and 33 with which the opposite edges of the extremity of an arm 34 of the two-arm lever 18 are provided.

The extremity of the other arm 35 of the two-arm lever 18 has passing through it, a pin 36 parallel to the shaft 11. With the part of the extremity that is turned towards the wall 2, the said pin 36 supports a roller 37, made preferably of rubber or of some other resilient material, and this is able to rest, as will be explained better in due course, against one or the other of the two abutment profiles 38 and 39, respectively, (the former on the left and the latter on the right in FIGS. 4 to 7), with which the upper edge of the plate 22 is provided. Machined in the other extreme section of the pin 36 there are two annular slots shown at 40 and 41, respectively, (the former on the right and the latter on the left in FIG. 3).

The said slots 40 and 41 are aligned, each along a plane perpendicular to the shaft 11, with two identical slots 42 and 43, respectively, with which a pin 44 parallel to the pin 36 and supported by the extremity of an arm 45 of the said two-arm lever 19, is provided.

A helical torsion spring 46 is wound around the previously mentioned tubular element 20, and the two extremities of the spring, shown at 47 and 48, extend towards the pair of pins 36 and 44.

Figure 4:
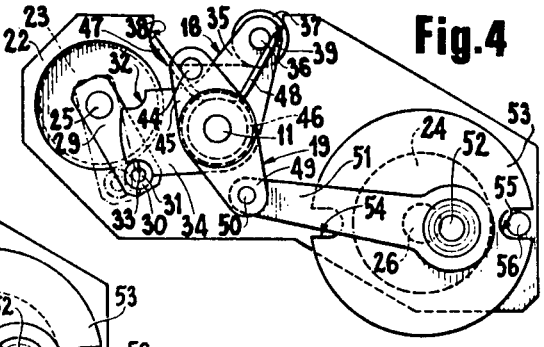
FIGS. 4, 5, 6 and 7 show diagrammatically, four different operating stages for the mechanism depicted in FIG. 3.
Figure 5:
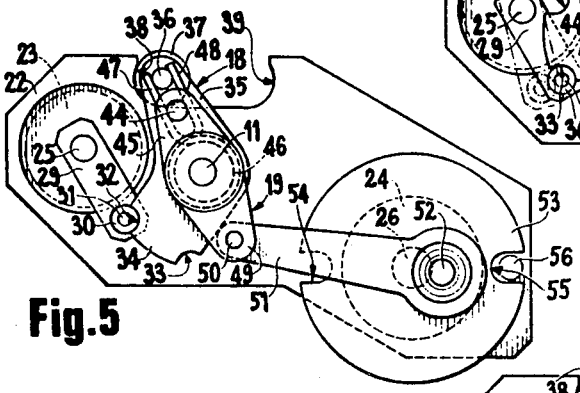
Figure 6:
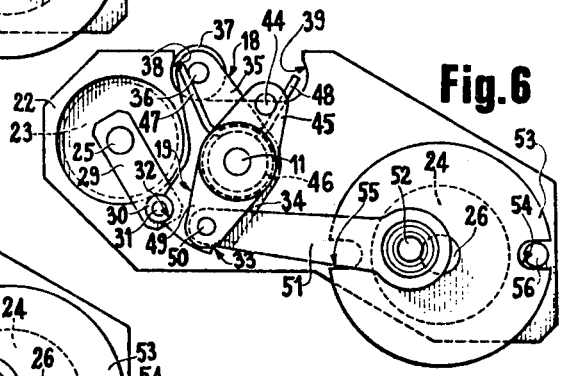
Figure 7:
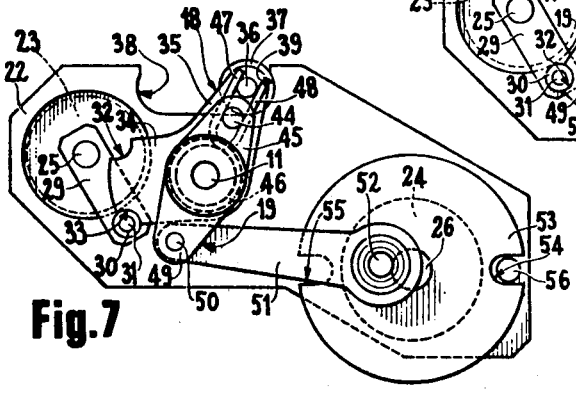

More precisely, in any operating condition of the device in question, the said extremities 47 and 48 are situated on opposite sides with respect to the said pair of pins 36 and 44 and are adjacent to the pair of slots 41 and 43, respectively, and to the pair of slots 40 and 42, respectively, when in the situations as illustrated in FIGS. 5 and 7, while they engage with the slots 43-40 or 42-41, respectively, during the operating stages shown in FIGS. 4 and 6.

The other arm of said lever 19, shown at 49, is connected, via a pin 50, to one extremity of a link rod 51, the free extremity of which is connected eccentrically, through a pin 52 parallel to the pins 36 and 44, to a disk 53 keyed to the shaft 26.

In two diametrically opposed areas of the said disk 53 there is a cutaway 54 and 55, respectively, and as the said disk 53 rotates these, in turn, face a capacitive sensor 56 supported by the plate 22.

The said capacitive sensor 56 is connected to a switch 57 that is placed along the line supplying electricity to the motor 24, and is in an open condition when one of the cutaways 54 or 55 is facing the said sensor 56.

Figure 8:
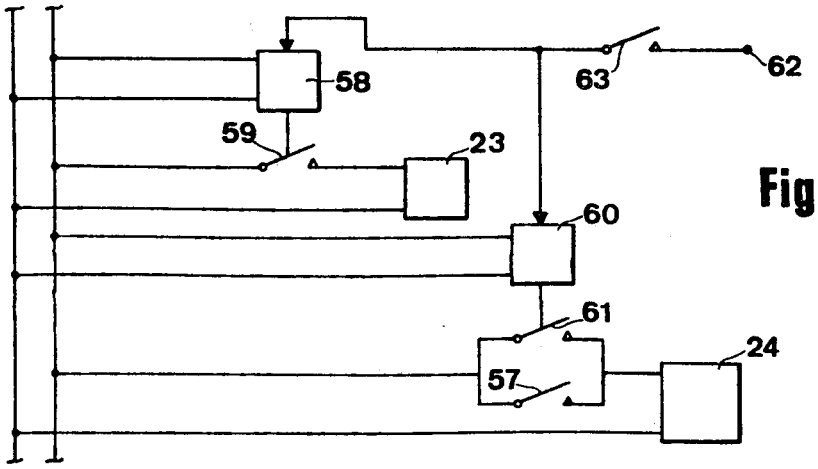
FIG. 8 shows diagrammatically, the electrical circuit for the operation of the device according to the invention.

The electrical circuit for the operation of the described device, illustrated in FIG. 8, comprises, furthermore, a timer 58 with an opening lag, the purpose of which is to operate a normally open switch 59 located along the line supplying electricity to the electromagnet 23.

A second timer 60 with both a closing and an opening lag, operates a normally open switch 61 paralleled with the said switch 57.

The delay with which the timer 58 is able, from the moment it is energized, to close the switch 59 has been deliberately chosen greater than that with which the timer 60 reopens the switch 61 after having closed it.

The excitation of both the timers 58 and 60 takes place, through the sending of a consent signal coming from a terminal 62, upon the closing of a normally open switch 63.

In use, with the operating situation being as shown in FIG. 1, the separating element 13 occupies an upper limit position, hereinafter defined the first position, and it intercepts the rod 5 causing it to deviate from the normal path and to go towards a non-illustrated reject bin.

A lower limit position, defined the second position (see FIG. 2), is reached by the element 13 following a counterclockwise rotation of this around the shaft 11.

As the deflector 8 passes from the first to the second position, the rod 5 is subjected to stress whereby it is broken in the region of the upper generatrix of the roller 4, and thus the deviated section that has been separated drops downwards.

At this juncture, the new leading end of the rod 5 is directed towards the verification device 6 with the rectilineal path being resumed.

An examination will now be made of FIGS. 4 to 7 in which four different dispositions the mechanism of the device in question is able to adopt, are illustrated.

With reference to FIG. 4, in which the angular position of the shaft 11 is such as to maintain the deflector 8 in the said second position, the two-arm lever 18 is maintained in a condition of maximum clockwise rotation around its fulcrum, with the roller 37 resting, thanks to the roller 30 engaging inside the recess 33, against the abutment profile 39.

The two-arm lever 19 is, instead, kept in a condition of maximum counterclockwise rotation around the shaft 11, by the link rod 51, and through the pin 44 coacting with the pin 36 of the two-arm lever 18, it maintains the spring 46 loaded.

The displacement of the separating element 13 from the second to the first position occurs each time the cigarette making machine comes to a halt, the purpose of this being to eliminate, once operation is resumed, the leading section of the rod of tobacco 5. The said displacement can also take place at any moment while the cigarette making machine is running, due to emergency conditions having arisen, in order to interrupt the supply of the rod 5 to the cutting device.

In practice, the said displacement from the said second to the said first position takes place with the closing, through manual tripping or upon the operation of non-illustrated control devices, of the switch 63.

As a result of the closing of the latter, the timers 58 and 60 are energized, and through the switch 59, the timer 58 causes the excitation of the electromagnet 23. In consequence of this, the bar 29 is displaced into the position shown with dots and dashes in FIG. 4 freeing the engagement of the lever 18 with the roller 30.

This is followed by the lever 18 tripping into the position shown in FIG. 5, and the deflector 8 passes into the said first position and breaks, if the cigarette making machine is running, the rod 5 by means of the loosely turning roller 12.

The said timer 58 then causes the switch 59 to reopen, and the bar 29 returns to its former position carrying the roller 30 in engagement with the recess 32.

At a moment immediately subsequent thereto, in accordance with what is shown in FIG. 6, the timer 60 determines the closing of the switch 61 and the starting of the motor 24 which, through the disk 53 and the link rod 51, causes the two-arm lever 19 to rotate clockwise around the shaft 11. Immediately after the motor 24 has been set in motion, the cutaway 55 moves away from the capacitive sensor 56 causing the switch 57 to close. and this is followed by the reopening of the switch 61 on the part of the timer 60.

Because of the rotation of the disk 53, the two-arm lever 19 rotates clockwise around the shaft 11 and loads, through the described combined action of the pins 36 and 44, the spring 46 in such a way that the lever 18 be subjected to torque in a clockwise direction, contrasted by the roller 30 engaged in the recess 32.

Once the disk 53 has rotated through 180°, the cutaway 54 arrives at the sensor 56 and causes the switch 57 to open and, consequently, the halting of the motor 24.

From this moment, the mechanism of the device is able to adopt, upon the switch 59 closing and in accordance with a similar procedure to that seen for the deflector 8 to pass from the second to the first position, the disposition depicted in FIG. 7, that is to say, to determine the tripping of the lever 18 whereby the deflector 8 connected thereto be returned to the position as per FIG. 2.

With a fresh rotation through 180° of the disk 53, the reloading is achieved in the previously examined way, of the spring 46 for a return to the condition shown in FIG. 4.

It is obvious from the foregoing that the device according to the invention, by overcoming the described difficulties experienced with the devices of a known-type, makes it possible to modify, at any moment and with extreme rapidity, the path followed by a rod of tobacco or filter in a cigarette making machine.

Naturally, leaving the principles of the invention unchanged, the variations it would be possible to make to the device described purely as an unlimited example, without because of this deviating from the framework of the invention, are numerous.

The device in question can, in fact, be gainfully used, for example, with the deflector 8 suitably dimensioned and shaped to alter the path followed by a number of side by side rods of tobacco or filter formed contemporaneously by a cigarette making machine.

What is claimed is:

1. Device for breaking at least one continuous rod moved along a path in a machine for making products for smokers, comprising a separating element movable across the path of the said rod from a first to a second position, and wherein there are operating means of an elastic type for displacing the said separating element alternately from the said first to the said second position, and from the said second to the said first position, automatic means for loading the said operating means of an elastic type, means for restraining the said separating element in positions corresponding to the said first and the said second position, and means for controlling the said means of restraint.

2. Breaking device according to claim 1, wherein the said separating element is mounted oscillating on a shaft virtually perpendicular to the said rod, and the said operating means of an elastic type are constituted by a helical torsion spring wound around the said shaft, a first extremity of which terminates at means of transmission integral with the said separating element, and a second extremity of which terminates at the said loading means.

3. Breaking device according to claims 1 or 2, wherein the said loading means comprise a two-arm lever mounted on the said shaft, this engaging through one of the said arms, with the said second extremity of the spring, and operating means connected to the other arm of the said lever.

4. Breaking device according to claims 1 or 2, wherein the said means of transmission comprise a two-arm lever mounted on the said shaft, at one arm of which terminates the said first extremity of the said spring, and with the second arm of which can be engaged the said means of restraint.

* * * * *